US011626065B2

(12) United States Patent
Zheng

(10) Patent No.: US 11,626,065 B2
(45) Date of Patent: Apr. 11, 2023

(54) DISPLAY SUBSTRATE, DRIVING METHOD THEREOF AND DISPLAY DEVICE

(71) Applicant: BOE TECHNOLOGY GROUP CO., LTD., Beijing (CN)

(72) Inventor: Can Zheng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/440,259

(22) PCT Filed: Jan. 5, 2021

(86) PCT No.: PCT/CN2021/070307

§ 371 (c)(1),
(2) Date: Sep. 17, 2021

(87) PCT Pub. No.: WO2021/139648

PCT Pub. Date: Jul. 15, 2021

(65) Prior Publication Data

US 2022/0157233 A1 May 19, 2022

(30) Foreign Application Priority Data

Jan. 8, 2020 (CN) ..... 202010018942.8

(51) Int. Cl.
*G09G 3/3208* (2016.01)

(52) U.S. Cl.
CPC ..... *G09G 3/3208* (2013.01); *G09G 2300/0465* (2013.01); *G09G 2310/0297* (2013.01); *G09G 2310/08* (2013.01); *G09G 2320/0233* (2013.01)

(58) Field of Classification Search
None
See application file for complete search history.

(56) References Cited

U.S. PATENT DOCUMENTS

2009/0225009 A1* 9/2009 Ka ..... G09G 3/3233 345/76
2017/0309645 A1 10/2017 Yang et al.

FOREIGN PATENT DOCUMENTS

| | | | |
|---|---|---|---|
| CN | 103065556 | A | 4/2013 |
| CN | 105068349 | A | 11/2015 |
| CN | 107331363 | A | 11/2017 |
| CN | 110619840 | A | 12/2019 |
| CN | 110690265 | A | 1/2020 |
| CN | 110707139 | A | 1/2020 |
| CN | 210667751 | U | 6/2020 |

* cited by examiner

*Primary Examiner* — Christopher J Kohlman
(74) *Attorney, Agent, or Firm* — Houtteman Law LLC

(57) ABSTRACT

A display substrate includes a display region, a non-display region at a periphery of the display region, pixel units in the display region and arranged in an array, gate lines extending in a row direction of the array, and data lines extending in a column direction of the array. Each row of pixel units is provided with at least one gate line, and each gate line is coupled to at least a part of the pixel units in a corresponding row. Each column of pixel units is provided with at least two data lines, and each data line is coupled to a part of the pixel units in a corresponding column. Each pixel unit is coupled to one gate line and one data line, and two pixel units in a same column and in two adjacent rows are coupled to different data lines, respectively.

18 Claims, 9 Drawing Sheets

DISPLAY SUBSTRATE, DRIVING METHOD THEREOF AND DISPLAY DEVICE

CROSS-REFERENCE TO RELATED APPLICATIONS

This is a National Phase Application filed under 35 U.S.C. 371 as a national stage of PCT/CN2021/070307 filed on Jan. 5, 2021, an application claiming priority to Chinese patent application No. 202010018942.8, filed on Jan. 8, 2020, the content of each of which is incorporated herein by reference in its entirety.

TECHNICAL FIELD

The present disclosure relates to the field of display technologies, and in particular to a display substrate, a driving method of a display substrate, and a display device.

BACKGROUND

An organic light-emitting diode (OLED) belongs to a current-driven light-emitting device, and a pixel driving circuit is required to provide a driving current to the OLED to cause the OLED to emit light. For example, a driving transistor may be a core device in the pixel driving circuit, and may provide a driving current to the OLED. It is desirable that driving transistors of an OLED substrate have a same (or uniform) threshold voltage to drive respective OLEDs to emit light with a same brightness, thereby improving a display effect of the OLED substrate.

SUMMARY

Some embodiments of the present disclosure provide a display substrate, a driving method thereof, and a display device.

A first aspect of the present disclosure provides a display substrate, which includes:

a display region;

a non-display region at a periphery of the display region;

a plurality of pixel units in the display region and arranged in an array;

a plurality of gate lines extending in a row direction of the array; and a plurality of data lines extending in a column direction of the array, wherein each row of pixel units is provided with at least one corresponding gate line, and each gate line is coupled to at least a part of the pixel units in a row corresponding to the gate line;

each column of pixel units is provided with at least two corresponding data lines, and each data line is coupled to a part of the pixel units in a column corresponding to data line; and each of the pixel units is coupled to one of the gate lines and one of the data lines, and two pixel units in a same column and in two adjacent rows are coupled to different data lines, respectively.

In an embodiment, the display substrate further includes a plurality of multiplexer circuits in the non-display region, wherein:

each multiplexer circuit corresponds to at least one column of pixel units; and each multiplexer circuit includes a data signal input terminal and a plurality of data signal output terminals, the plurality of data signal output terminals are coupled to the data lines provided for the at least one column of pixel units corresponding to the multiplexer circuit, respectively, and the plurality of data signal output terminals are in one-to-one correspondence with the data lines provided for the at least one column of pixel units corresponding to the multiplexer circuit.

In an embodiment, each row of pixel units is provided with m corresponding gate lines, and a k-th gate line of the m gate lines is coupled to the pixel units in a $(b\times m+k)$-th column among the pixel units in a corresponding row, where m is a positive integer and $1\leq k\leq m$, b is a non-negative integer and $(b\times m+k)\leq M$, and M is a total number of columns of pixel units in the array.

In an embodiment, m is 2, and 2 gate lines corresponding to each row of pixel units are a first gate line and a second gate line, respectively; and the first gate line is coupled to the pixel units in odd-numbered columns among the pixel units in the corresponding row, and the second gate line is coupled to the pixel units in even-numbered columns among the pixel units in the corresponding row.

In an embodiment, each column of pixel units is provided with 2 corresponding data lines, and the 2 data lines are a first data line and a second data line, respectively; and the first data line is coupled to the pixel units in odd-numbered rows among the pixel units in a corresponding column, and the second data line is coupled to the pixel units in even-numbered rows among the pixel units in the corresponding column.

In an embodiment, every two adjacent columns of pixel units correspond to one multiplexer circuit;

each multiplexer circuit includes a first switch, a second switch, a third switch, and a fourth switch;

a first terminal of the first switch, a first terminal of the second switch, a first terminal of the third switch, and a first terminal of the fourth switch are all coupled to the data signal input terminal of the multiplexer circuit; and a second terminal of the first switch and a second terminal of the second switch are coupled to 2 first data lines provided for two columns of pixel units corresponding to the multiplexer circuit, respectively, and a second terminal of the third switch and a second terminal of the fourth switch are coupled to 2 second data lines provided for two columns of pixel units corresponding to the multiplexer circuit, respectively.

In an embodiment, each column of pixel units is provided with n corresponding data lines, where n is an integer and $n\geq 2$;

an i-th data line of the n data lines is coupled to the pixel units in a $(a\times n+i)$-th row among the pixel units in a corresponding column, where i is an integer and $1\leq i\leq n$, a is a non-negative integer and $(a\times n+i)\leq N$, and N is a total number of rows of pixel units in the array.

In an embodiment, each row of pixel units is provided with 1 corresponding gate line, which is coupled to all of the pixel units in the row.

In an embodiment, each column of pixel units corresponds to one multiplexer circuit of the plurality of multiplexer circuits, the one multiplexer circuit includes n switches, wherein first terminals of the n switches are all coupled to the data signal input terminal of the one multiplexer circuit; and a second terminal of a j-th switch of the n switches is coupled to a j-th data line provided for the corresponding column of pixel units, where j is an integer and $1 \leq j \leq n$.

In an embodiment, n is 4.

In an embodiment, two of 4 data lines corresponding to a same column of pixel units are on one side of the corresponding column of pixel units, and the remaining two of the 4 data lines corresponding to the column of pixel units are on a side, which is opposite to the one side, of the corresponding column of pixel units.

In an embodiment, the m gate lines provided for each row of pixel units are on a same side of the row of pixel units.

In an embodiment, the two data lines on a same side of a same column of pixel units are in different layers, respectively.

In an embodiment, orthogonal projections of the two data lines, which are in different layers, on a plane where the display substrate is located overlap each other.

A second aspect of the present disclosure provides a display device, which includes the display substrate according to any one of the foregoing embodiments of the first aspect of the present disclosure.

A third aspect of the present disclosure provides a driving method of a display substrate, wherein the display substrate is the display substrate according to any one of the foregoing embodiments of the first aspect of the present disclosure, and the driving method includes:

writing a gate scanning driving signal to the gate lines sequentially in a predetermined order to drive the pixel units respectively corresponding to the gate lines, and writing a corresponding data signal to the data line coupled to driven pixel units;

wherein a writing time period for writing a data signal to each data line each time is H/c, and an interval between start time points for writing data signals to a same data line twice consecutively is T, where H is a predetermined total time period for completing data writing to all of the pixel units in one row, c is a number of gate lines provided for the one row of pixel units, and $T>H$; and a writing time period for writing a gate scanning driving signal to a same gate line each time is T', where $H<T' \leq T$.

In an embodiment, in the display substrate m is equal to 2, and the writing time period for writing the data signal to each data line each time is H/2;

the interval T between the start time points for writing the data signals to a same data line twice consecutively is 2H; and the writing time period T' for writing the gate scanning driving signal to each gate line each time is 2H.

In an embodiment, in the display substrate each column of pixel units is provided with n corresponding data lines, where n is an integer and $n \geq 2$, and the writing time period for writing the data signal to each data line each time is H;

the interval T between the start time points for writing the data signals to a same data line twice consecutively is $n \times H$; and the writing time period T' for writing the gate scanning driving signal to each gate line each time is $n \times H$.

DETAILED DESCRIPTION

Figure 1:
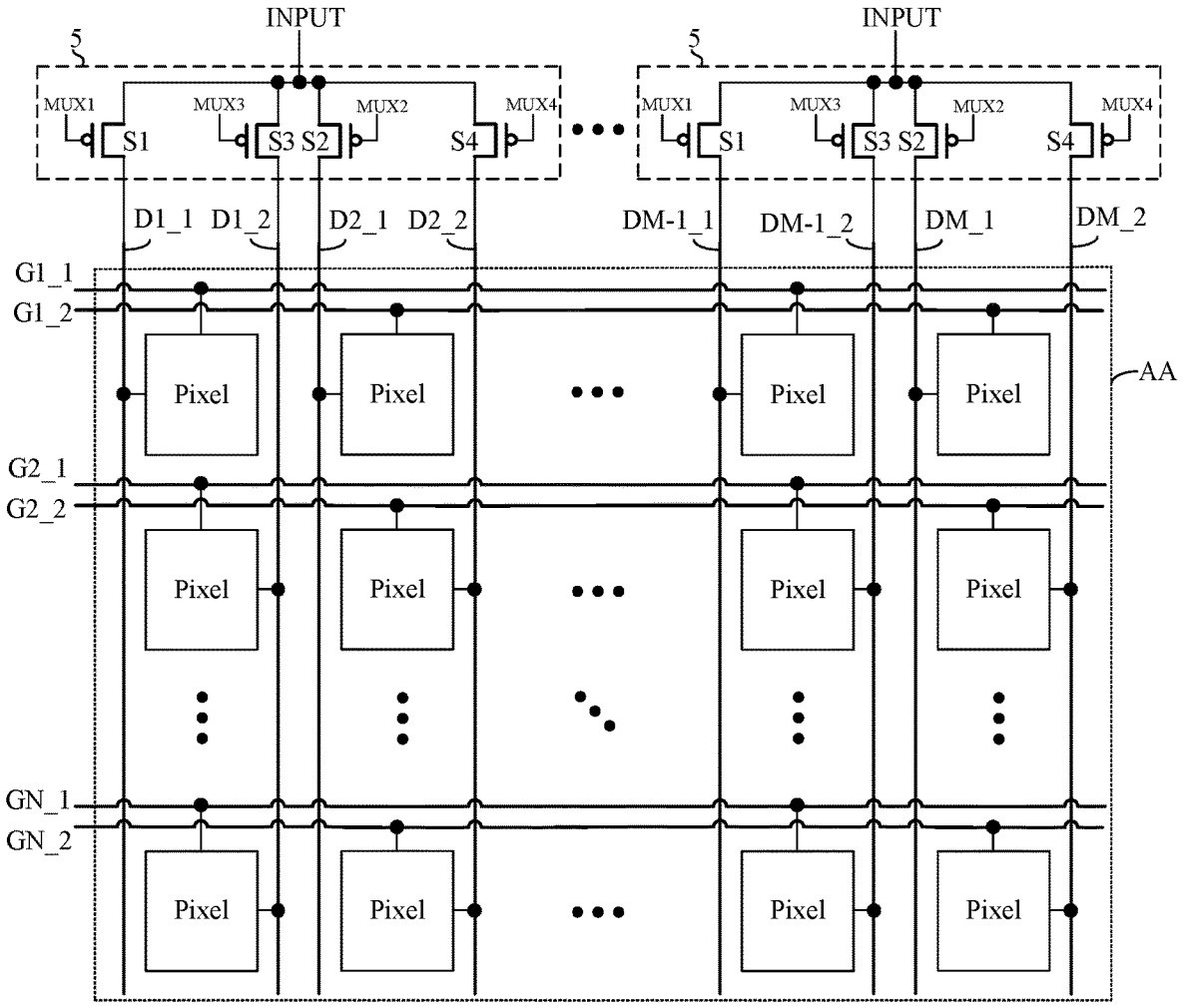
FIG. 1 is a schematic diagram showing a circuit structure of a display substrate according to an embodiment of the present disclosure.

To enable one of ordinary skill in the art to better understand technical solutions of the present disclosure, a display substrate, a driving method of a display substrate, and a display device provided by the present disclosure will be described in detail below with reference to the accompanying drawings.

Exemplary embodiments will be described more fully hereinafter with reference to the accompanying drawings, but may be embodied in different forms and should not be construed as limited to the forms set forth herein. Rather, the exemplary embodiments are provided such that the present disclosure will be thorough and complete, and will fully convey the scope of the present disclosure to one of ordinary skill in the art.

The terms used herein are for the purpose of describing exemplary embodiments only and are not intended to limit the scope of the present disclosure. As used herein, the singular form of "a", "an" and "the" is intended to include the plural form as well, unless the context clearly indicates otherwise. It should be further understood that the terms of "comprising" and/or "including", when used herein, specify the presence of stated features, integers, steps, operations, elements, and/or components, but do not preclude the presence or addition of one or more other features, integers, steps, operations, elements, components, and/or groups thereof.

It should be understood that, although the terms such as first, second, etc. may be used herein to describe various elements/structures, these elements/structures should not be limited by the terms. The terms are only used for distinguishing one element/structure from another element/structure.

Unless otherwise defined, all terms (including technical and scientific terms) used herein have the same meaning as commonly understood by one of ordinary skill in the art. It should be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It should be noted that the transistors used in an embodiment of the present disclosure may be thin film transistors or field effect transistors or other devices with the same or similar characteristics. Since source electrodes and drain electrodes of the transistors used are symmetrical, there is no difference between the source electrodes and the drain electrodes. In an embodiment of the present disclosure, to distinguish the source electrode and the drain electrode of a transistor, one of the source electrode and the drain electrode may be referred to as a first electrode, the other thereof may be referred to as a second electrode, and a gate electrode of the transistor may be referred to as a control electrode. In addition, the transistors can be classified as N-type and P-type according to the characteristics of the transistors. The following embodiments will be described by taking an example in which P-type transistors are adopted. In the case of adopting the P-type transistors, the first electrodes may be the source electrodes of the P-type transistors, and the second electrodes may be the drain electrodes of the P-type transistors. Alternatively, an embodiment of the present disclosure may employ N-type transistors. In the case of employing N-type transistors, the first electrodes may be the drain electrodes of the N-type transistors, and the second electrodes may be the source electrodes of the N-type transistors.

A "valid level" (or "turn-on level") in the present disclosure refers to a level that can control the turn-on of a corresponding transistor. Specifically, for a P-type transistor, the corresponding valid level is a low level; and for an N-type transistor, the corresponding valid level is a high level.

The inventor of the present inventive concept has found that, due to factors such as a tolerance of a manufacturing process of the driving transistors on the OLED substrate, a drift of electrical characteristics during operation, and the like, threshold voltages of driving transistors on an OLED substrate are different, such that different OLEDs emit light with different brightnesses and a display effect thereof is reduced. Therefore, the threshold voltages of the driving transistors needs to be compensated during a driving process to compensate for the difference between the threshold voltages of the driving transistors, such that the OLEDs of the OLED substrate have the same (or uniform) brightness, and the display effect of the OLED substrate is improved.

However, the inventor of the present inventive concept has found in practical applications that, a writing time period for writing a gate scanning driving signal (which may be simply referred to as a "scanning signal") to each gate line is decreased as a resolution is increased. Since a time period of threshold compensation of the pixel driving circuit is equal to the writing time period for writing the gate scanning driving signal to each gate line, the time period of threshold compensation of the pixel driving circuit is also decreased accordingly, thereby resulting in a poor compensation effect.

FIG. 1 is a schematic diagram showing a circuit structure of a display substrate according to an embodiment of the present disclosure. As shown in FIG. 1, the display substrate includes: a display region (which may also be referred to as an Active Area) AA and a non-display region NA (e.g., a region above and on the left of the display region AA in FIG. 10) located at (e.g., surrounding) a periphery of the display region AA. The display region AA is provided therein with a plurality of pixel units Pixel arranged in an array, a plurality of gate lines G1_1 to GN_2 extending in a row direction of the array, and a plurality of data lines D1_1 to DM_2 extending in a column direction of the array. In an embodiment of the present disclosure, description is made by taking an example in which the array includes N rows and M columns with N*M pixel units Pixel.

For example, each row of pixel units Pixel is provided with at least one corresponding gate line (e.g., in FIG. 1, a first row of pixel units Pixel is provided with two corresponding gate lines G1_1 and G1_2, a second row of pixel units Pixel is provided with two corresponding gate lines G2_1 and G2_2, . . . , an (N−1)-th row of pixel units Pixel is provided with two corresponding gate lines GN-1_1 and GN-1_2, and an N-th row of pixel units Pixel is provided with two corresponding gate lines GN_1 and GN_2), and each of the gate lines G1_1, G1_2, . . . , GN_1 and GN_2 is coupled to at least a part of the pixel units Pixel in a corresponding row of pixel units Pixel (which will be further described below). Each column of pixel units Pixel is provided with at least two corresponding data lines (e.g., in FIG. 1, a first column of pixel units Pixel is provided with two corresponding data lines D1_1 and D1_2, a second column of pixel units Pixel is provided with two corresponding data lines D2_1 and D2_2, . . . , an (M−1)-th column of pixel units Pixel is provided with two corresponding data lines DM-1_1 and DM-2_2, and an M-th column of pixel units Pixel is provided with two corresponding data lines DM_1 and DM_2), and each of the data lines D1_1, D1_2, . . . , DM_1 and DM_2 is coupled to a part of the pixel units Pixel in a corresponding column of pixel units Pixel (which will be further described below). Each of the pixel units Pixel is coupled to one of the gate lines G1_1, G1_2, . . . , GN_1 and GN_2 and one of the data lines D1_1, D1_2, . . . , DM_1 and DM_2, and two pixel units located in a same column and in two adjacent rows are coupled to different two of the data lines D1_1, D1_2, . . . , DM_1 and DM_2.

For example, each pixel unit Pixel includes a pixel driving circuit and a light-emitting device. Each pixel driving circuit is coupled to one of the gate lines G1_1, G1_2, . . . , GN_1 and GN_2 which corresponds to the row where the pixel driving circuit is located, and one of the data lines D1_1, D1_2, . . . , DM_1 and DM_2 which corresponds to the column where the pixel driving circuit is located, and may provide a driving current to a corresponding light-emitting device according to a data signal provided by the corresponding data line, to drive the corresponding light-emitting device to emit light. Each light-emitting device may be a current-driven type light-emitting device such as an OLED, a light-emitting diode (LED), or the like. The present disclosure will be further described by taking an example in which the light-emitting device is an OLED.

Based on the display substrate provided by an embodiment of the present disclosure, in a process of driving the display substrate to display, a writing time period for writing a gate scanning driving signal to each of the gate lines G1_1, G1_2, . . . , GN_1 and GN_2 can be increased, and a time period of threshold compensation of the pixel driving circuit in each pixel unit Pixel is increased correspondingly, thereby improving the compensation effect.

The technical solutions of the present disclosure will be further described in detail below with reference to specific examples and the accompanying drawings.

Figure 2:
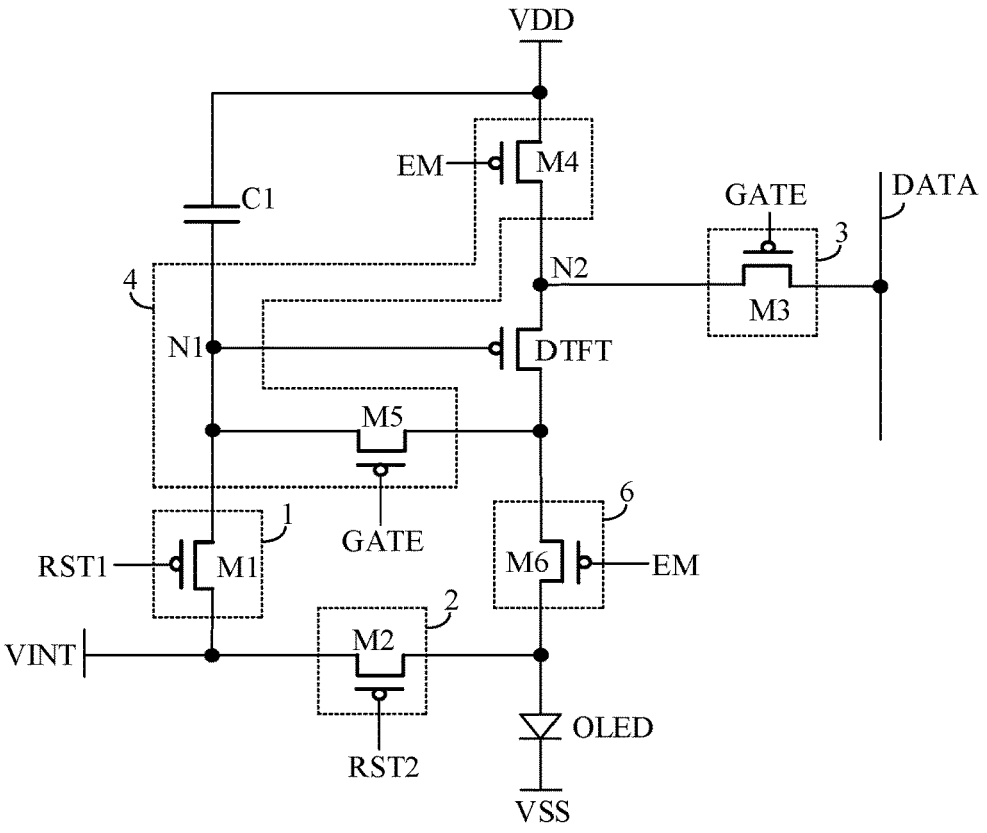
FIG. 2 is a schematic diagram showing a structure of a pixel driving circuit according to an embodiment of the present disclosure.

FIG. 2 is a schematic diagram showing a structure of a pixel driving circuit according to an embodiment of the present disclosure. For example, the structure of each pixel unit Pixel shown in FIG. 1 may be the structure as shown in FIG. 2. The symbol "OLED" in FIG. 2 denotes a light-emitting device of each pixel unit Pixel, and transistors M1 to M6 and a storage capacitor C1 in FIG. 2 may form the pixel driving circuit of each pixel unit Pixel. As shown in FIG. 2, in some embodiments, each pixel driving circuit includes a first reset sub-circuit 1, a second reset sub-circuit 2, a data write sub-circuit 3, a threshold compensation sub-circuit 4, and a driving transistor DTFT.

The first reset sub-circuit 1 is coupled to a first power source terminal (i.e., a terminal indicated by "VINT" in FIG.

2), a control electrode (i.e., a gate electrode) of the driving transistor DTFT, and a corresponding first reset signal line RST1, and is configured to write a first voltage supplied from the first power source terminal to the control electrode of the driving transistor DTFT in response to control of the first reset signal line RST1.

The second reset sub-circuit 2 is coupled to the first power source terminal, a first terminal of the light-emitting device OLED, and a corresponding second reset signal line RST2, and is configured to write the first voltage supplied from the first power source terminal to the first terminal of the light-emitting device OLED in response to control of the second reset signal line RST2.

The data write sub-circuit 3 is coupled to a first electrode of the driving transistor DTFT, a corresponding data line DATA, and a corresponding gate line GATE, and is configured to write a data voltage Vdata supplied from the data line DATA to the first electrode of the driving transistor DTFT in response to control of the gate line GATE.

The threshold compensation sub-circuit 4 is coupled to a second power source terminal (i.e., a terminal indicated by "VDD" in FIG. 2), the control electrode of the driving transistor DTFT, the first electrode of the driving transistor DTFT, a second electrode of the driving transistor DTFT, and the corresponding gate line GATE, and is configured to write a data compensation voltage, which is equal to a sum of the data voltage Vdata supplied from the data line DATA and a threshold voltage Vth of the driving transistor DTFT, to the control electrode of the driving transistor DTFT in response to the control of the gate line GATE.

The second electrode of the driving transistor DTFT is coupled to the first terminal of the light-emitting device OLED, and the driving transistor DTFT is configured to output a corresponding driving current in response to the control of the data compensation voltage. A second terminal of the light-emitting device OLED is coupled to a third power source terminal (i.e., a terminal indicated by "VSS" in FIG. 2).

With continued reference to FIG. 2, in some embodiments, the first reset sub-circuit 1 includes a first transistor M1, and the second reset sub-circuit 2 includes a second transistor M2. The data write sub-circuit 3 includes a third transistor M3, and the threshold compensation sub-circuit 4 includes a fourth transistor M4 and a fifth transistor M5.

For example, a control electrode of the first transistor M1 is coupled to the first reset signal line RST1, a first electrode of the first transistor M1 is coupled to the first power source terminal, and a second electrode of the first transistor M1 is coupled to the control electrode of the driving transistor DTFT.

A control electrode of the second transistor M2 is coupled to the second reset signal line RST2, a first electrode of the second transistor M2 is coupled to the first power source terminal, and a second electrode of the second transistor M2 is coupled to the first terminal of the light-emitting device.

A control electrode of the third transistor M3 is coupled to the gate line GATE, a first electrode of the third transistor M3 is coupled to the data line DATA, and a second electrode of the third transistor M3 is coupled to the first electrode of the driving transistor DTFT.

A control electrode of the fourth transistor M4 is coupled to a light emission control signal line EM, a first electrode of the fourth transistor M4 is coupled to the second power source terminal, and a second electrode of the fourth transistor M4 is coupled to the first electrode of the driving transistor DTFT.

A control electrode of the fifth transistor M5 is coupled to the gate line GATE, a first electrode of the fifth transistor M5 is coupled to the control electrode of the driving transistor DTFT, and a second electrode of the fifth transistor M5 is coupled to the second electrode of the driving transistor DTFT.

In some embodiments, the pixel driving circuit further includes a light emission control sub-circuit 6, and the light emission control sub-circuit 6 includes a sixth transistor M6. The second electrode of the driving transistor DTFT is coupled to the first terminal of the light-emitting device through the sixth transistor M6. Specifically, a control electrode of the sixth transistor M6 is coupled to the light emission control signal line EM, a first electrode of the sixth transistor M6 is coupled to the second electrode of the driving transistor DTFT, and a second electrode of the sixth transistor M6 is coupled to the first terminal of the light-emitting device.

An operation of the pixel driving circuit shown in FIG. 2 will be described below in detail. The first voltage supplied from the first power source terminal may be a reset voltage VINT, a second voltage supplied from the second power source terminal may be an operating voltage VDD, and a third voltage supplied from the third power source terminal may be another operating voltage VSS. For example, the operating voltage VDD may be a high voltage, the operating voltage VSS may be a low voltage (e.g., ground voltage), and VDD>VSS.

Figure 3:
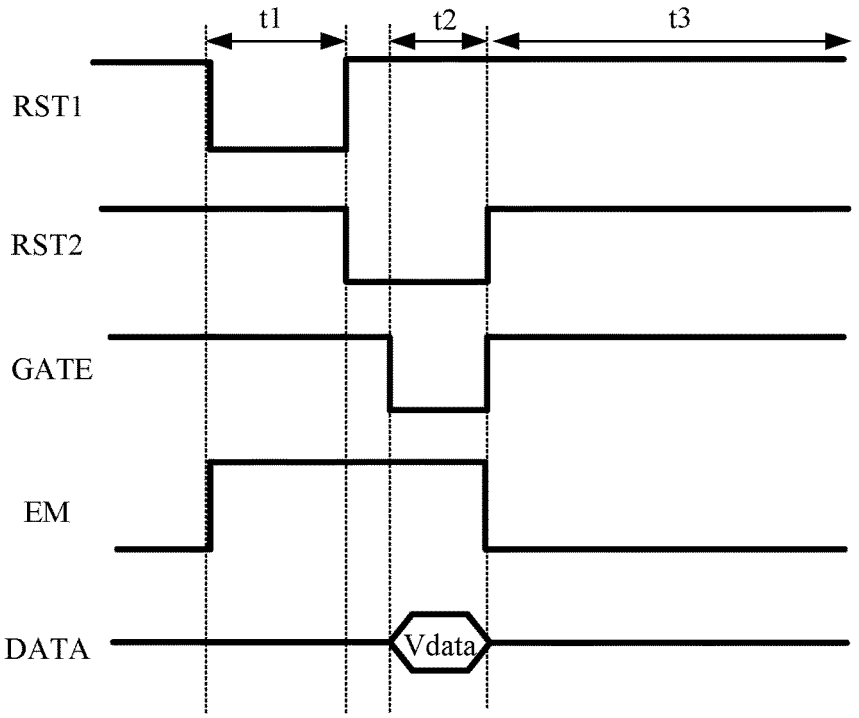
FIG. 3 is a schematic timing diagram showing operation of the pixel driving circuit shown in FIG. 2.

FIG. 3 is a schematic timing diagram showing an operation of the pixel driving circuit shown in FIG. 2. As shown in FIG. 3, the operation of the pixel driving circuit includes a reset stage t1, a data writing and compensating stage t2, and a light-emitting stage t3.

During the reset stage t1, the first reset signal line RST1 supplies (or provides) a low-level signal, the second reset signal line RST2 supplies a high-level signal, the gate line GATE supplies a high-level signal, and the light emission control signal line EM supplies a high-level signal.

Since the first reset signal line RST1 provides the low-level signal, the first transistor M1 is turned on, and the reset voltage VINT (which may be, for example, a low level) is written to a node N1 through the first transistor M1, so as to reset the control electrode of the driving transistor DTFT. Meanwhile, since each of the second reset signal line RST2, the gate line GATE, and the light emission control signal line EM provides the high-level signal, the second to sixth transistors M2 to M6 are all turned off.

During the data writing and compensating stage t2, the first reset signal line RST1 provides a high-level signal, the second reset signal line RST2 provides a low-level signal, the gate line GATE provides a low-level signal, and the light emission control signal line EM provides a high-level signal.

Since the first reset signal line RST1 provides the high-level signal, the first transistor M1 is turned off. Meanwhile, since the gate line GATE provides the low-level signal, the third transistor M3 and the fifth transistor M5 are both turned on, the data voltage provided by the data line is written to a node N2 through the third transistor M3, at this time, the driving transistor DTFT is in a turned-on state, and the node N1 is charged through the fifth transistor M5, until a voltage at the node N1 is charged to Vdata+Vth. At this time, the driving transistor DTFT is turned off, and the charging is completed. Here, Vdata is the data voltage provided by the data line DATA, and Vth is the threshold voltage of the driving transistor DTFT.

At this time, since the second reset signal line RST2 provides the low-level signal, the second transistor M2 is turned on, and the reset voltage VINT is written to the first terminal of the light-emitting device OLED through the second transistor M2, to reset the first terminal of the light-emitting device OLED.

It should be noted that, in the process of charging the node N1 by an output current of the driving transistor DTFT, since the sixth transistor M6 is turned off, the light-emitting device OLED can be prevented from emitting light by mistake, thereby improving the display effect. Optionally, in some embodiments, the sixth transistor M6 may be omitted (i.e., the light emission control sub-circuit 6 may be omitted).

During the light-emitting stage t3, the first reset signal line RST1 supplies a high-level signal, the second reset signal line RST2 supplies a high-level signal, the gate line GATE supplies a high-level signal, and the light emission control signal line EM supplies a low-level signal.

Since the light emission control signal line EM supplies the low-level signal, the fourth transistor M4 and the sixth transistor M6 are turned on, and the driving transistor DTFT outputs a driving current I according to the voltage at the node N1 to drive the light-emitting device OLED to emit light. In this case, according to a saturated driving current formula of the driving transistor DTFT, the following formula may be derived:

$$\begin{aligned} I &= K^*(Vgs - Vth)^2 \\ &= K^*(Vdata + Vth - VDD - Vth)^2 \\ &= K^*(Vdata - VDD)^2, \end{aligned}$$

where K is a constant (a magnitude of which is related to electrical characteristics of the driving transistor DTFT), and Vgs is a gate-source voltage of the driving transistor DTFT. As can be seen from the above formula, the driving current of the driving transistor DTFT is only related to the data voltage Vdata and the operating voltage VDD, but is not related to the threshold voltage Vth of the driving transistor DTFT, thereby preventing the driving current flowing through the light-emitting device OLED from being affected by the non-uniformity and drift of the threshold voltage, and improving the uniformity of the driving current flowing through the light-emitting device OLED effectively. In this way, the uniformity of the brightnesses of the light-emitting devices OLED can be improved, thereby improving the display effect of the display substrate including the light-emitting devices OLED.

In some embodiments, to ensure that the voltage at the node N1 is Vdata+Vth all the time (i.e., is always Vdata+Vth) during the light-emitting stage t3, the pixel driving circuit may be further provided with a storage capacitor C1, a first terminal of the storage capacitor C1 is coupled to the second power source terminal, and a second terminal of the storage capacitor C1 is coupled to the node N1 and the control electrode of the driving transistor, respectively.

It should be noted that the pixel driving circuit shown in FIG. 2 is only an exemplary embodiment of the present disclosure, and is not intended to limit the technical solutions of the present disclosure.

It can be seen from the foregoing description that, in the process of driving each pixel unit, the time period of the threshold compensation of the pixel driving circuit of the pixel unit is equal to the writing time period for writing the gate scanning driving signal provided by the corresponding gate line, i.e., is equal to a duration of the data writing and compensating stage t2 (i.e., a duration during which the corresponding gate line is at the valid level).

Figure 4:
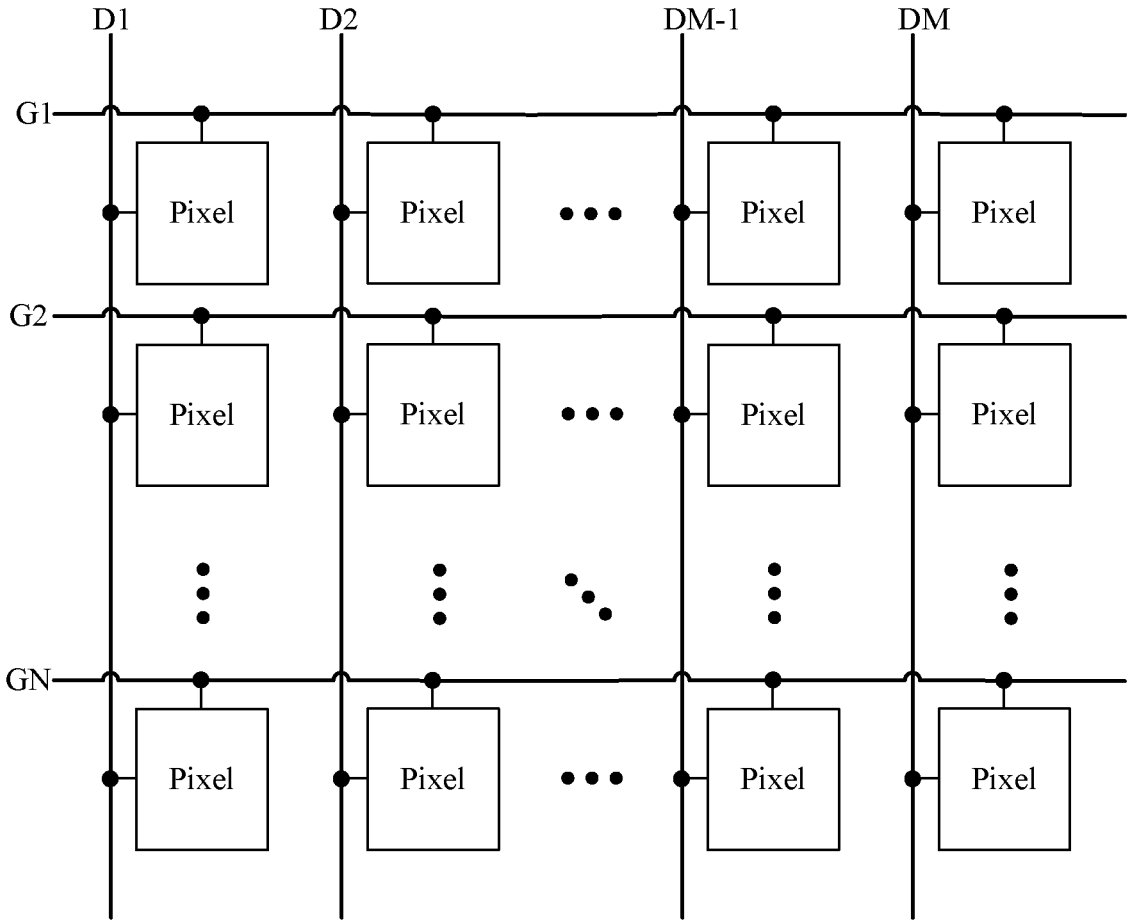
FIG. 4 is a schematic diagram showing a structure of another display substrate according to an embodiment of the present disclosure.

FIG. 4 is a schematic diagram showing a structure of a display substrate according to an embodiment of the present disclosure. As shown in FIG. 4, in the display substrate, rows of pixel units Pixel are in one-to-one correspondence with gate lines G1, G2, . . . , and GN, and columns of pixel units Pixel are in one-to-one correspondence with data lines D1, D2, . . . , and DM.

In order to ensure a sufficiently high refresh rate (e.g., 60 HZ) during a display process of a display device, a total of time period for completing data writing to an entire row of pixel units Pixel during a driving process is configured (or set). For example, if the total of time period for completing data writing to an entire row of pixel units Pixel is configured in advance to be H, the writing time period for writing the gate scanning driving signal to each of the gate lines G1, G2, . . . , and GN in the display substrate shown in FIG. 4 is H, and a writing time period, for writing the data signal to each of the data lines D1, D2, . . . , and DM by a source driver SDRIVER (see FIG. 10) each time, is H. That is, the duration of the data writing and compensating stage t2 during driving the pixels is H.

In an embodiment of the present disclosure, if the number of the gate lines provided for each row of pixel units Pixel is c, a writing time period, for writing the data signal to each of the data lines by the source driver SDRIVER each time, is H/c. Since two pixel units Pixel in a same column and in two adjacent rows are coupled to different data lines, respectively, an interval T between start time points for writing the data signal twice continuously by the source driver to a same data line may be greater than H, and in this case, a writing time period T', for writing the gate scanning driving signal to each gate line by a gate driver GDRIVER (see FIG. 10) each time, may also be greater than H, where T'≤T. It should be noted that the source driver SDRIVER and the gate driver GDRIVER will be further described below in conjunction with FIG. 10.

As can be seen from the foregoing description, compared with the embodiment shown in FIG. 4, when the display substrate according to another embodiment of the present disclosure is driven to display, the writing time period for writing gate scanning driving signal to each gate line can be increased, i.e., the duration of the data writing and compensating stage t2 of each pixel driving circuit during a driving process may be increased, such that a threshold compensation process of the driving transistor DTFT of each pixel driving circuit is fully performed, and the compensation effect is effectively improved.

Figure 10:
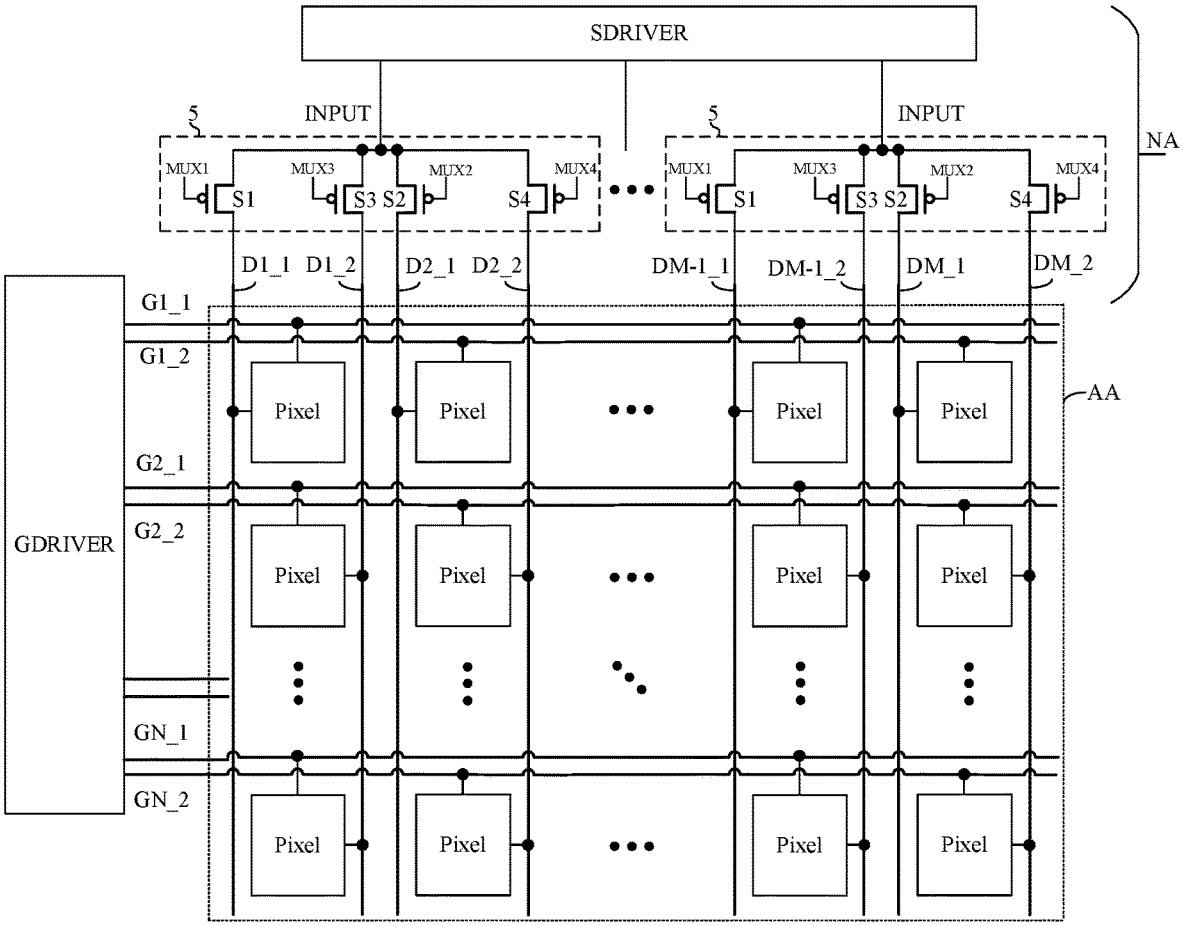
FIG. 10 is a schematic diagram showing a structure of a display device according to an embodiment of the present disclosure.

With continued reference to FIG. 1, in order to reduce the number of data lines, which are coupled to the source driver SDRIVER, of the array of pixel units Pixel in the display region AA shown in FIG. 1, to reduce the number of lead lines in a peripheral region of the display substrate and to realize a narrow-border design; in addition, in order to reduce the number of signal output terminals (which may be in one-to-one correspondence with data signal input terminals INPUT of a plurality of multiplexer circuits 5, as shown in FIG. 10) of the source driver SDRIVER required, to reduce the requirements on a performance of the source driver SDRIVER, the display substrate shown in FIG. 1 may further include a plurality of multiplexer circuits 5 as described below.

To solve the above technical problems, in an embodiment of the present disclosure, a plurality of multiplexer circuits 5 are disposed in the non-display region NA (see FIG. 10) of the display substrate, and each of the plurality of multiplexer circuits 5 corresponds to (e.g., is coupled to) at least one column of pixel units Pixel. Each multiplexer circuit 5 is provided with a data signal input terminal INPUT and a plurality of data signal output terminals. The plurality of data signal output terminals are coupled to a plurality of data lines provided for at least one column of pixel units corresponding to (e.g., coupled to) the multiplexer circuit, respectively, and the plurality of data signal output terminals are in one-to-one correspondence with the plurality of data lines. For example, the data signal input terminal INPUT of each multiplexer circuit 5 may be a signal output terminal of the source driver SDRIVER (see FIG. 10). Each multiplexer circuit 5 is configured to write a plurality of data signals provided from the data signal input terminal INPUT of the multiplexer circuit 5 to the data lines coupled to the data signal output terminals of the multiplexer circuit 5, respectively.

In the display substrate of the present embodiment, by providing the plurality of multiplexer circuits 5, the number of the lead lines in the peripheral region of the display substrate can be reduced, which is advantageous for narrow-border design. Meanwhile, the required number of signal output terminals of the source driver SDRIVER is also reduced, thereby reducing the requirements on a performance of the source driver.

Generally, the more data signal output terminals of each multiplexer circuit 5 are, the more kinds of gating control signal lines (or strobe control signal lines) that need to be provided for the multiplexer circuit 5 are (e.g., 1 (i.e., one) data signal output terminal of the multiplexer circuit 5 corresponds to one kind of gating control signal line), and the higher the requirement on a control chip that supplies a gating control signal is. In an example, the number of data signal output terminals included in each multiplexer circuit 5 may be less than or equal to 8. In the example of FIG. 1, the number of data signal output terminals included in each multiplexer circuit 5 is equal to 4.

In some embodiments, each row of pixel units is provided with m gate lines, and a k-th gate line of the m gate lines is coupled to the pixel unit in a (b×m+k)-th column among the pixel units in a corresponding row, where m is a positive integer and $1 \le k \le m$, b is a non-negative integer and $b \times m + k \le M$, and M is the total number of columns of pixel units in the array. For example, in the example of FIG. 1, m is equal to 2, k is equal to 1 or 2, and b is equal to 0, 1, 2, . . . .

The larger the number of the gate lines provided for each row of pixel units is, the smaller the number of the pixel units coupled to each gate line is, such that the less the load on each gate line is, which facilitates the writing of the gate scanning driving signals. However, an increase of the number of gate lines may result in a decrease in aperture ratio of each pixel. Therefore, in an embodiment of the present disclosure, as one example, $1 \le m \le 4$.

With continued reference to FIG. 1, in some embodiments, each row of pixel units Pixel is provided with 2 (i.e., two) corresponding gate lines. For example, the first row of pixel units Pixel is provided with 2 gate lines G1_1 and G1_2, the second row of pixel units Pixel is provided with 2 gate lines G2_1 and G2_2, . . . , and the N-th row of pixel units Pixel is provided with 2 gate lines GN_1 and GN_2. The gate lines may include first gate lines G1_1, G2_1, . . . , and GN_1 and second gate lines G1_2, G2_2, . . . , and GN_2. The first gate lines G1_1, G2_1, . . . , and GN_1 may be coupled to the pixel units Pixel in odd-numbered columns among the pixel units Pixel in respective rows, and the second gate lines G1_2, G2_2, . . . , and GN_2 may be coupled to the pixel units Pixel in even-numbered columns among the pixel units Pixel in the respective rows. Alternatively, the first gate lines G1_1, G2_1, . . . . , and GN_1 may be coupled to the pixel units Pixel in even-numbered columns among the pixel units Pixel in the respective rows, and the second gate lines G1_2, G2_2, . . . , and GN_2 may be coupled to the pixel units Pixel in odd-numbered columns among the pixel units Pixel in the respective rows. Each column of pixel units Pixel is provided with 2 corresponding data lines. For example, the first column of pixel units Pixel is provided with 2 data lines D1_1 and D1_2, the second column of pixel units Pixel is provided with 2 data lines D2_1 and D2_2, . . . , and the M-th column of pixel units Pixel is provided with 2 data lines DM_1 and DM_2. The data lines may include first data lines D1_1, D2_1, . . . . , and DM_1 and second data lines D1_2, D2_2, . . . , and DM_2. The first data lines D1_1, D2_1, . . . , and DM_1 may be coupled to the pixel units Pixel in odd-numbered rows among the pixel units Pixel in respective columns, and the second data lines D1_2, D2_2, . . . , and DM_2 may be coupled to the pixel units Pixel in even-numbered rows among the pixel units Pixel in the respective columns. Alternatively, the first data lines D1_1, D2_1, . . . , and DM_1 may be coupled to the pixel units Pixel in even-numbered rows among the pixel units Pixel in the respective columns, and the second data lines D1_2, D2_2, . . . , and DM_2 may be coupled to the pixel units Pixel in odd-numbered rows among the pixel units Pixel in the respective columns.

In some embodiments, the first gate lines G1_1, G2_1, . . . , and GN_1 and the second gate lines G1_2, G2_2, . . . . , and GN_2 are respectively located on the same sides of the respective rows of pixel units Pixel. Taking the case shown in FIG. 1 as an example, the first gate lines G1_1, G2_1, . . . , and GN_1 and the second gate lines G1_2, G2_2, . . . , and GN_2 are respectively located at the upper sides of the respective rows of pixel units Pixel. Alternatively, in other embodiments of the present disclosure, the first gate lines G1_1, G2_1, . . . , and GN_1 and the second gate lines G1_2, G2_2, . . . , and GN_2 may be respectively located at opposite sides of the respective rows of pixel units Pixel (e.g., the lower sides of the respective rows of pixel units Pixel shown in FIG. 1).

In some embodiments, every two adjacent columns of pixel units Pixel correspond to (e.g., are coupled to) one multiplexer circuit 5, and each multiplexer circuit 5 is coupled to 4 data lines provided for the two columns of pixel units Pixel corresponding to the multiplexer circuit 5, as shown in FIG. 1. Each multiplexer circuit 5 is further coupled to a data signal input terminal INPUT (or one signal output terminal of the source driver SDRIVER), and is configured to write 4 data signals supplied (or received) from the data signal input terminal INPUT to the 4 data lines coupled to the multiplexer circuit 5, respectively.

In some embodiments, each multiplexer circuit 5 includes a first switch S1, a second switch S2, a third switch S3, and a fourth switch S4. A first terminal of the first switch S1, a first terminal of the second switch S2, a first terminal of the third switch S3, and a first terminal of the fourth switch S4 are all coupled to the data signal input terminal INPUT. A second terminal of the first switch S1 and a second terminal of the second switch S2 are respectively coupled to 2 first data lines (i.e., adjacent two of the first data lines D1_1, D2_1, . . . , and DM_1) provided for two columns of pixel units Pixel corresponding to the multiplexer circuit 5, and a second terminal of the third switch S3 and a second terminal of the fourth switch S4 are respectively coupled to 2 second data lines (i.e., adjacent two of the second data lines D1_2, D2_2, . . . , and DM_2) provided for the two columns of pixel units Pixel corresponding to the multiplexer circuit 5. For example, each of the first to fourth switches S1 to S4 is capable of controlling electric connection or electric disconnection between the first and second terminals thereof.

In some embodiments, each of the first to fourth switches S1 to S4 is a switching transistor, and control electrodes of the first to fourth switches S1 to S4 are respectively coupled to a first gating control signal line MUX1, a second gating control signal line MUX2, a third gating control signal line MUX3, and a fourth gating control signal line MUX4.

In the present disclosure, by providing the multiplexer circuits 5, the number of signal output terminals of the source driver SDRIVER can be effectively reduced, which is advantageous for simplifying a structure of the source driver. Meanwhile, the number of wirings in a periphery of the non-display region NA can be reduced by providing the multiplexer circuits 5, which is advantageous for the narrow-border design.

Taking the embodiment shown in FIG. 1 as an example, 4 data lines correspond to (e.g., are coupled via one multiplexer circuit 5 to) one signal output terminal of the source driver SDRIVER (i.e., 4 data lines correspond to one data signal input terminal INPUT). For example, 4 data lines D1_1, D1_2, D2_1 and D2_2 may be coupled to the source driver SDRIVER through a same signal line (a signal line located between the multiplexer circuit 5 and a corresponding signal output terminal of the source driver SDRIVER, as shown in FIG. 10), . . . , and 4 data lines DM-1_1, DM-1_2, DM_1 and DM_2 may be coupled to the source driver SDRIVER through a same signal line. For example, as shown in FIG. 10, each of the multiplexer circuits 5 is coupled to 4 data lines, and is coupled to the source driver SDRIVER through one signal line. In this way, in the display substrate or a display device, the number of signal lines in the periphery of the non-display region is significantly less than the number of data lines, which is beneficial to the narrow-border design and the simplification of the structure of the source driver SDRIVER.

The principle of a driving process of the display substrate according to an embodiment of the present disclosure will be described below by taking a driving process of a part of the pixel units Pixel in the display substrate as an example.

Figure 5:
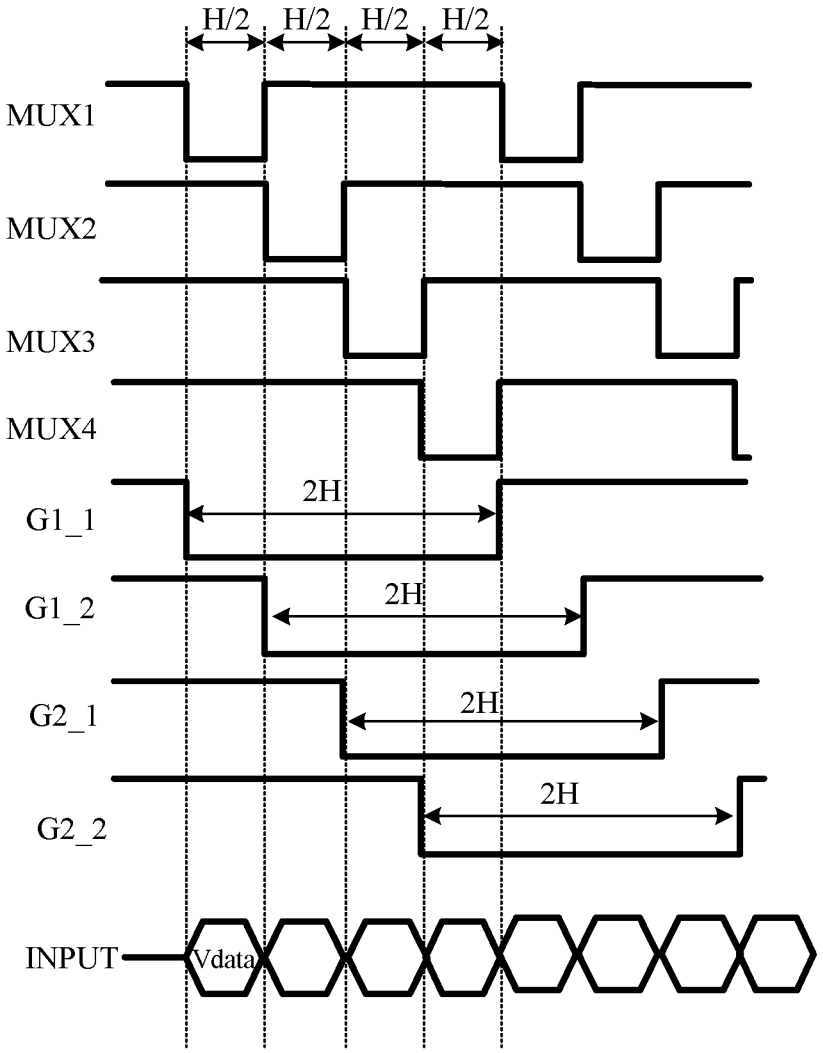
FIG. 5 is a schematic timing diagram for driving the display substrate shown in FIG. 1.

FIG. 5 is a schematic timing diagram for driving the display substrate shown in FIG. 1. As shown in FIG. 5, the first switch S1, the second switch S2, the third switch S3 and the fourth switch S4 in each multiplexer circuit 5 are turned on sequentially under the control of control signals provided from the first gating control signal line MUX1, the second gating control signal line MUX2, the third gating control signal line MUX3 and the fourth gating control signal line MUX4, respectively, thereby writing a data signal (e.g., the data voltage Vdata) provided by the source driver to the first data lines D1_1, D2_1, . . . , and DM_1 and the second data lines D1_2, D2_2, . . . , and DM_2 respectively coupled to the first to fourth switches S1 to S4, respectively.

Since each row of pixel units Pixel correspond to (e.g., is provided with) 2 gate lines, and the total of time period for completing data writing to all of the pixel units Pixel in each row in the case where each row of pixel units Pixel corresponds to (e.g., is provided with) one gate line (as shown in FIG. 4) is predetermined (i.e., configured in advance) as H, a writing time period, for writing the data signal to each of the first data lines D1_1, D2_1, . . . , and DM_1 and the second data lines D1_2, D2_2, . . . , and DM_2 each time, is H/2, i.e., a duration, for which each of the first switch S1 to the fourth switch S4 is in a turn-on state each time, is H/2. In this case, an interval T between the start time points for writing the data signal twice continuously by the source driver SDRIVER to a same data line is 2H, such that the maximum value of the writing time period T' for writing the gate scanning driving signal to each gate line by the gate driver GDRIVER may be 2H.

It should be noted that, FIG. 5 only schematically illustrates a case where the writing time period T' for writing the gate scanning driving signal by the gate driver to each gate line is 2H. It should be understood by one of ordinary skill in the art that in an embodiment of the present disclosure, it is only necessary to ensure that the writing time period T' satisfies the requirements of $H<T'\leq T$, and $T=2H$ to increase the duration of the data writing and compensating stage t2 to some extent (such that the time period of threshold compensation of the pixel driving circuit in each pixel unit Pixel is also increased accordingly), thereby improving the compensation effect.

In addition, in a driving process based on the timing shown in FIG. 5, a time period for completing writing a data signal to each data line of the data lines D1_1, D1_2, D2_1, D2_2, . . . , DM_1, and DM_2 is H/2, the data line is in a floating state for a time period of 3H/2 thereafter, and a load capacitor formed on the data line can maintain a previously loaded data signal on the data line.

Taking the example of writing a data signal to the data lines D1_1 and D2_1 once, during a first time period of H/2, when the first switch S1 is turned on under control of the first gating control signal line MUX1, a data signal is output from the source driver SDRIVER and is written to the first data line D1_1 through the first switch S1. During a second time period of H/2, when the first switch S1 is turned off under control of the first gating control signal line MUX1 and the second switch S2 is turned on under control of the second gating control signal line MUX2, a data signal is output from the source driver SDRIVER and is written to the first data line D2_1 through the second switch S2. In this case, the first data line D1_1 is in a floating state, and a load capacitor formed on the first data line D1_1 can maintain the data signal previously loaded on the first data line D1_1. In a similar manner, when the fifth time period of H/2 begins, the first switch S1 is turned on again under control of the first gating control signal line MUX1, the source driver writes a new data signal to the first data line D1_1. Thus, the interval between the start time points for consecutively writing data signals by the source driver to the same first data line D1_1 twice is 2H.

Figure 6:
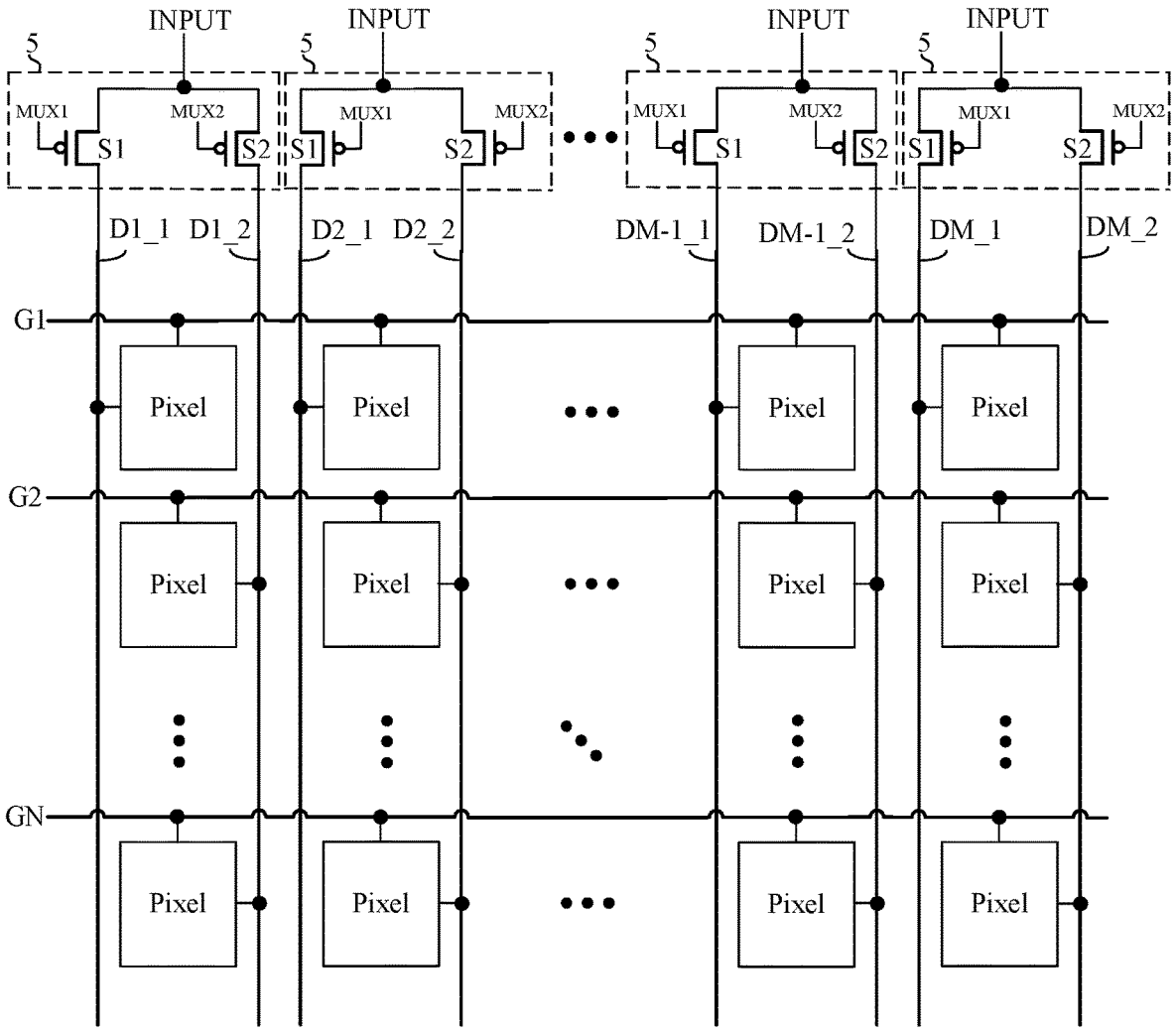
FIG. 6 is a schematic diagram showing a circuit structure of another display substrate according to an embodiment of the present disclosure.

FIG. 6 is a schematic diagram showing a circuit structure of another display substrate according to an embodiment of the present disclosure. Unlike the foregoing embodiments, each column of pixel units Pixel corresponds to (e.g., is coupled to) one multiplexer circuit 5 as shown in FIG. 6.

In some embodiments, each row of pixel units Pixel is provided with 1 (i.e., one) corresponding gate line (e.g., rows of pixel units Pixel are in one-to-one correspondence with gate lines G1, G2, . . . , and GN), and each gate line of the gate lines G1, G2, . . . , and GN is coupled to all of the pixel units Pixel in the row of pixel units Pixel corresponding to the gate line. Each column of pixel units Pixel is provided with n corresponding data lines, where n is an integer and $n\geq 2$. An i-th data line of the n data lines is coupled to the pixel units Pixel in an $(a\times n+i)$-th row among the pixel units Pixel in a column corresponding to the i-th data line, where i is an integer and $1\leq i\leq n$, a is a non-negative integer and $a\times n+i\leq N$, and N is the total number of rows of pixel units Pixel in the array. For example, in the example of FIG. 6, n is equal to 2, i is equal to 1 or 2, and α is equal to 0, 1, 2, . . . .

In some embodiments, each multiplexer circuit 5 is coupled to n data lines provided for the column of pixel units Pixel corresponding to the multiplexer circuit 5. Each multiplexer circuit 5 is also coupled to a data signal input terminal INPUT (or one signal output terminal of the source driver SDRIVER), and is configured to write n data signals supplied (or received) from the data signal input terminal INPUT to the n data lines coupled to the multiplexer circuit 5, respectively.

Further, each multiplexer circuit 5 includes n switches. First terminals of the n switches are coupled to a data signal input terminal INPUT of the multiplexer circuit 5, and a second terminal of a j-th switch of the n switches is coupled to a j-th data line of the data lines provided for the pixel units Pixel in the column corresponding to the multiplexer circuit 5, where j is an integer and $1 \leq j \leq n$, and N is the total number of rows of pixel units in the array.

In some embodiments, the switches in each multiplexer circuit 5 are all switching transistors.

It should be noted that FIG. 6 only illustrates a case where n is 2, i.e., each of the columns of pixel units Pixel is provided with 2 corresponding data lines (e.g., the first column of pixel units Pixel is provided with 2 corresponding data lines D1_1 and D1_2, the second column of pixel units Pixel is provided with 2 corresponding data lines D2_1 and D2_2, . . . , and the M-th column of pixel units Pixel is provided with 2 corresponding data lines DM_1 and DM_2), and the data lines may include first data lines D1_1, D2_1, . . . , and DM_1 and second data lines D1_2, D2_2, . . . , and DM_2. Each multiplexer circuit 5 may include 2 switches which are the first switch S1 and the second switch S2.

Figure 7:
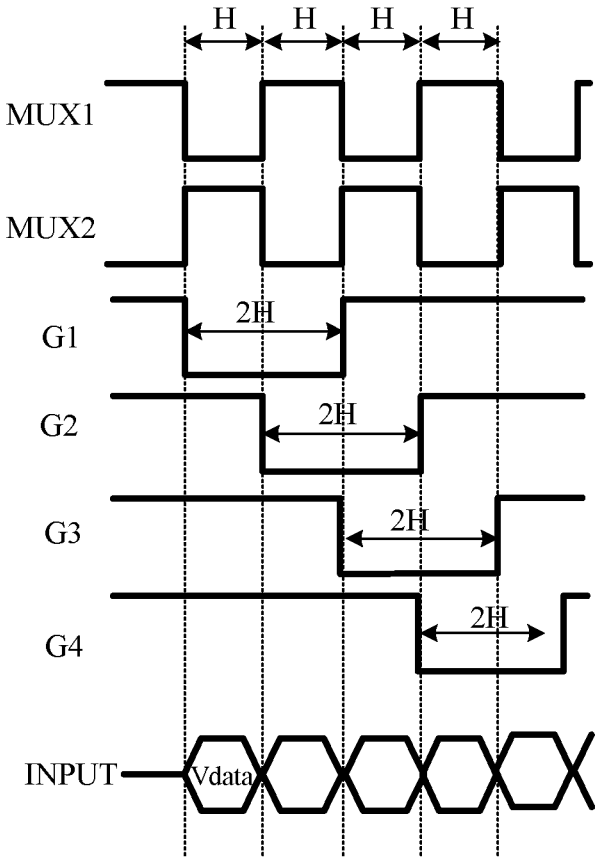
FIG. 7 is a schematic timing diagram for driving the display substrate shown in FIG. 6.

FIG. 7 is a schematic timing diagram for driving the display substrate shown in FIG. 6. As shown in FIG. 7, the first switch S1 and the second switch S2 of each multiplexer circuit are turned on sequentially under control of the control signals provided by the first gating control signal line MUX1 and the second gating control signal line MUX2, respectively, thereby writing data signals provided by the source driver SDRIVER to the first data line D1_1, D2_1, . . . , and DM_1 and the second data line D1_2, D2_2, . . . , and DM_2 respectively coupled to the first switch S1 and the second switch S2, respectively.

Since each row of pixel units Pixel corresponds to 1 (i.e., one) gate line, and the total time period for writing a data signal to all of the pixel units Pixel in each row is predetermined as H, the writing time period, for writing a data signal to each of the first data lines D1_1, D2_1, . . . , and DM_1 and the second data lines D1_2, D2_2, . . . , and DM_2 each time, is H, i.e., the duration of each of the first switch S1 and the second switch S2 is in a turn-on state each time is H. In this case, the interval T between the start time points for consecutively writing a data signal by the source driver to a same data line twice is 2H, and thus the maximum value of the writing time period T' for writing the gate scanning driving signal by the gate driver to each of the gate lines G1, G2, . . . , and GN is 2H.

It should be noted that FIG. 7 only schematically illustrates a case where the writing time period T' for writing the gate scanning driving signal by the gate driver to each of the gate lines G1, G2, . . . , and GN is 2H. However, it should be understood by one of ordinary skill in the art that in an embodiment of the present disclosure, it is only necessary to ensure that the writing time period T' satisfies the requirements of $H<T' \leq T$, and T=2H to increase the duration of the data writing and compensating stage t2 to some extent (such that the time period of threshold compensation of the pixel driving circuit in each pixel unit Pixel is also increased accordingly), thereby improving the compensation effect.

Figure 8:
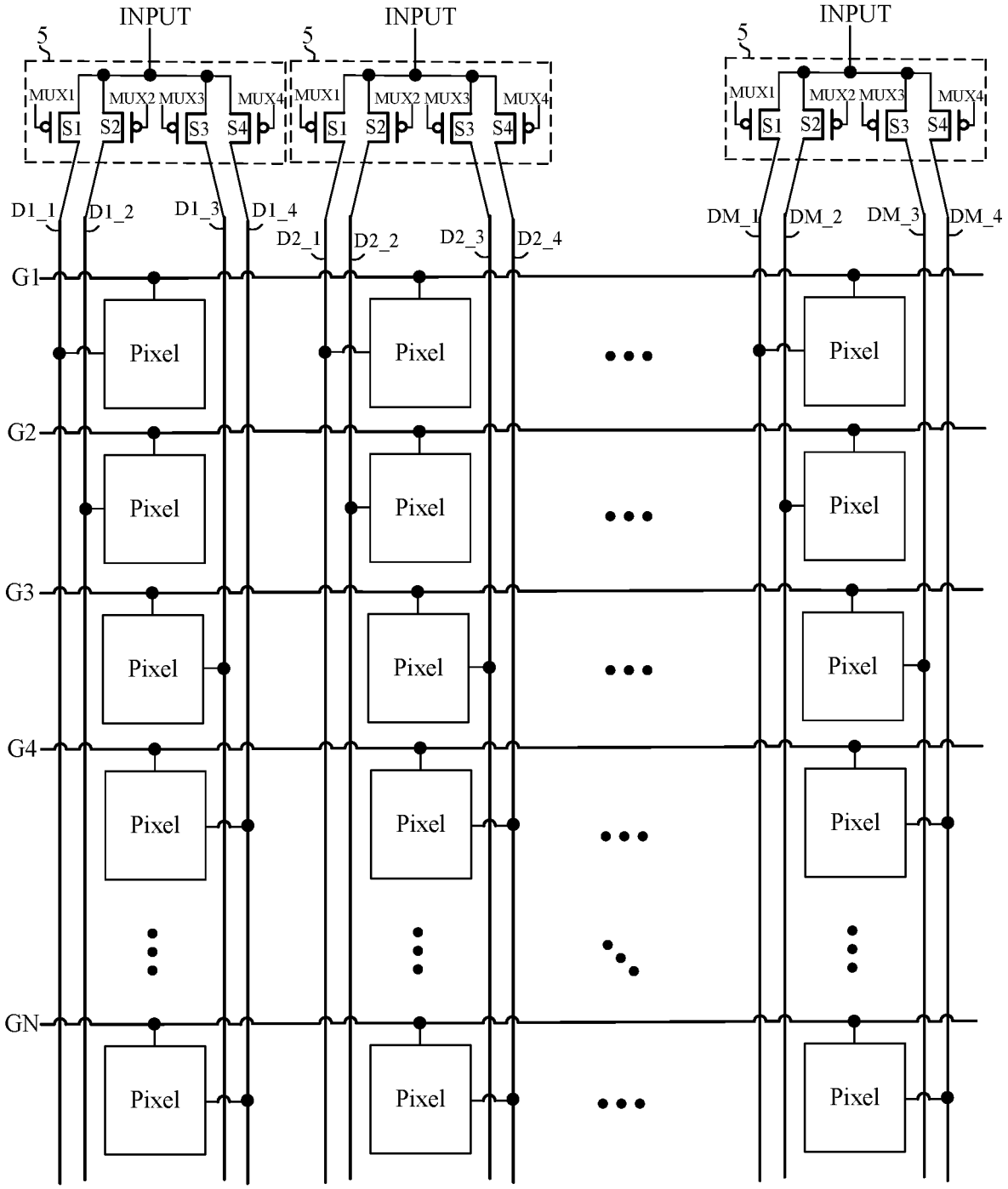
FIG. 8 is a schematic diagram showing a circuit structure of another display substrate according to an embodiment of the present disclosure.

FIG. 8 is a schematic diagram showing a circuit structure of another display substrate according to an embodiment of the present disclosure. As shown in FIG. 8, n is equal to 4, i.e., each column of pixel units Pixel is provided with 4 corresponding data lines. For example, the first column of pixel units Pixel is provided with 4 corresponding data lines D1_1, D1_2, D1_3 and D1_4, the second column of pixel units Pixel is provided with 4 corresponding data lines D2_1, D2_2, D2_3 and D2_4, . . . , and the M-th column of pixel units Pixel is provided with 4 corresponding data lines DM_1, DM_2, DM_3 and DM_4. These data lines may include first data lines D1_1, D2_1, . . . , and DM_1, second data lines D1_2, D2_2, . . . , and DM_2, third data lines D1_3, D2_3, . . . , and DM_3, and fourth data lines D1_4, D2_4 . . . , and DM_4. Each multiplexer circuit 5 includes 4 switches, which are a first switch S1, a second switch S2, a third switch S3, and a fourth switch S4.

In some embodiments, 4 data lines D1_1, D1_2, D1_3 and D1_4, 4 data lines D2_1, D2_2, D2_3 and D2_4, . . . , or 4 data lines DM_1, DM_2, DM_3 and DM_4 corresponding to a same column of pixel units Pixel are equally distributed on two opposite sides of the same column of pixel units Pixel. FIG. 8 schematically shows that the first data lines D1_1, D2_1, . . . , and DM_1 and the second data lines D1_2, D2_2, . . . , DM_2 are located on the left side of corresponding columns of pixel units Pixel, respectively, and the third data lines D1_3, D2_3, . . . , and DM_3 and the fourth data lines D1_4, D2_4, . . . , and DM_4 are located on the right side of the corresponding columns of pixel units Pixel, respectively.

Figure 9:
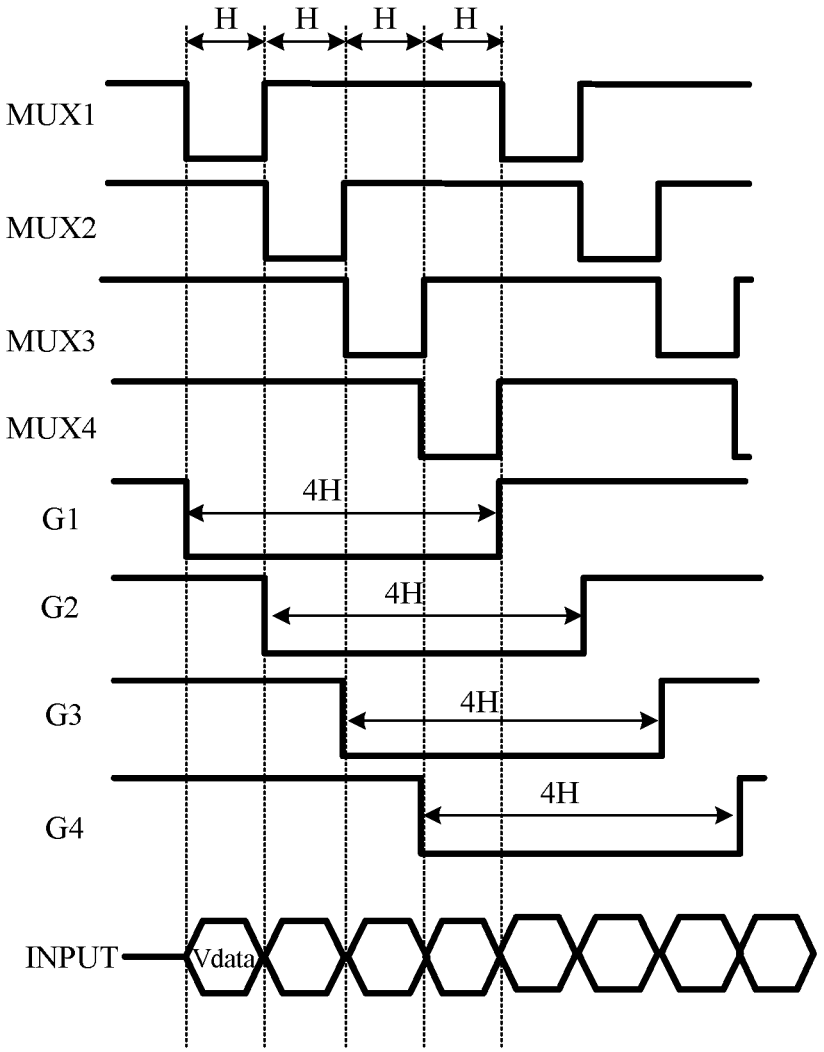
FIG. 9 is a schematic timing diagram for driving the display substrate shown in FIG. 8.

FIG. 9 is a schematic timing diagram for driving the display substrate shown in FIG. 8. As shown in FIG. 9, the first switch S1, the second switch S2, the third switch S3 and the fourth switch S4 in each multiplexer circuit 5 are sequentially turned on under control of the control signals provided by the first gating control signal line MUX1, the second gating control signal line MUX2, the third gating control signal line MUX3 and the fourth gating control signal line MUX4, respectively, thereby writing data signals provided by the source driver SDRIVER to the first data lines D1_1, D2_1, . . . , and DM_1 to the fourth data lines D1_4, D2_4, . . . , and DM_4 respectively coupled to the first switch S1 to the fourth switch S4, respectively.

Since each row of pixel units Pixel corresponds to 1 (i.e., one) gate line, and the total time period for writing a data signal to all of the pixel units Pixel in one row is predetermined as H, the writing time period, for writing a data signal to one data line each time, is H, i.e., the duration of each of the first switch S1 to the fourth switch S4 being in a turn-on state each time is H. In this case, the interval T between the start time points for writing data signals by the source driver to a same data line consecutively twice is 4H, and thus the maximum value of the writing time period T' for writing the gate scanning driving signal by the gate driver to each of the gate lines G1, G2, . . . , and GN is 4H.

It should be noted that FIG. 9 only schematically illustrates a case where the writing time period T' for the gate driver to write the gate scanning driving signal to each of the gate lines G1, G2, . . . , and GN is 4H. However, it should be understood by one of ordinary skill in the art that in an embodiment of the present disclosure, it is only necessary to ensure that the writing time period T' satisfies the requirements of $H<T' \leq T$, and T=4H to increase the duration of the data writing and compensating stage t2 to some extent (such that the time period of threshold compensation of the pixel driving circuit in each pixel unit Pixel is also increased accordingly), thereby improving the compensation effect.

In the present disclosure, the different data lines corresponding to a same column of pixel units Pixel may be disposed in a same layer or in different layers. The expression of being "in a same layer" in the present disclosure means that different structures are made of a same material and thus may be formed simultaneously by a single patterning process. Distances between different structures arranged in a same layer and a same reference plane (e.g., a substrate) may be the same or different. Taking the display substrate shown in FIG. 8 as an example, each first data line (e.g., D1_1) and each third data line (e.g., D1_3) may be disposed in a same layer, each second data line (e.g., D1_2) and each fourth data line (e.g., D1_4) may be disposed in a same layer, and each first data line (e.g., D1_1) and each second data line (e.g., D1_2) may be disposed in different layers. In order to improve an aperture ratio of each pixel, orthogonal projections of a first data line (e.g., D1_1) and a corresponding second data line (e.g., D1_2) which are arranged in different layers on a plane where the display substrate is located may overlap each other, and orthogonal projections of a third data line (e.g., D1_3) and a corresponding fourth data line (e.g., D1_4) which are arranged in different layers on the plane where the display substrate is located may overlap each other.

An embodiment of the present disclosure provides a driving method of a display substrate according to any one of the foregoing embodiments, and the driving method may include the following step Q1.

In step Q1, a gate scanning driving signal is written to the gate lines sequentially in a predetermined order to drive the pixel units corresponding to the gate lines, and a corresponding data signal is written to the data line coupled to the driven pixel units.

In an embodiment, the predetermined order for scanning the gate lines may be preset according to a practical requirement. For example, the predetermined order may be forward sequential scanning (i.e., sequential scanning from the first gate line to the N-th gate line), reverse sequential scanning (i.e., sequential scanning from the N-th gate line to the first gate line), or scanning according to a certain rule (e.g., interlaced scanning). In other words, the predetermined order may include a forward order, a reverse order, and the like.

In step Q1, the writing time period for the source driver SDRIVER to write a data signal to each data line each time is H/c, and the interval between the start time points for writing data signals to a same data line twice consecutively is T, where H is a predetermined total time period for completing data writing to all of the pixel units in one row, c is the number of gate lines provided for the one row of pixel units, T>H; and the writing time period for the gate driver to write a gate scanning driving signal to a gate line each time is T', where $H<T'\leq T$.

In an embodiment of the present disclosure, the number of data lines provided for each column of pixel units may be n, and the maximum value of the interval T between the start time points for the source driver to write data signals to a same data line twice consecutively may be set to n×H. In the present disclosure, it is only necessary to ensure that the value of the interval T is greater than H to allow the writing time period T' for writing a gate scanning driving signal to a gate line by the gate driver each time to be greater than H (e.g., in a case where the interval T is determined, the maximum value of the writing time period T' may be equal to T), thereby increasing a writing time period for writing a gate scanning driving signal to each gate line. As an example, when the interval T takes the maximum value of n×H, the maximum value of the writing time period T' for writing a gate scanning driving signal to a gate line by the gate driver each time may also be set to n×H. In this way, the writing time period, for writing a gate scanning driving signal to a gate line each time, can be increased to the maximum extent.

Compared with the embodiment shown in FIG. 4, when the driving method of the display substrate according to another embodiment of the present disclosure is used for display driving (i.e., for driving the display substrate to display), the writing time period for writing a gate scanning driving signal to each gate line can be increased, i.e., the duration of the data writing and compensating stage of each pixel driving circuit during the driving process can be increased, such that a threshold compensation process of the driving transistor DTFT of each pixel driving circuit is ensured to be performed sufficiently, which improves the compensation effect.

In some embodiments, when the display substrate shown in FIG. 1 is adopted, the number of gate lines provided for each row of pixel units is 2, the number of data lines provided for each column of pixel units is 2, the writing time period, for the source driver to write a data signal to each data line each time, is H/2, and the interval T between the start time points to write data signals to a same data line twice consecutively is 2H (which is the maximum value of the interval between the start time points to write data signals to a same data line twice consecutively, in the case where the number of data lines provided for each column of pixel units is 2). The writing time period T', for the gate driver to write a gate scanning driving signal to each gate line each time, is 2H.

In some embodiments, when the display substrate shown in FIG. 6 or FIG. 8 is adopted, the number of gate lines provided for each row of pixel units is 1 (i.e., one), the number of data lines provided for each column of pixel units is n, the writing time period, for the source driver to write a data signal to each data line each time, is H, and the interval T between the start time points to write data signals to a same data line twice consecutively is n×H (which is the maximum value of the interval between the start time points for writing data signals to a same data line twice consecutively, in the case where the number of data lines provided for each column of pixel units is n). The writing time period T', for the gate driver to write a gate scanning driving signal to each gate line each time, is n×H.

Further detailed description of the step Q1 may be referred to corresponding contents in the foregoing embodiments, and is not repeated here.

An embodiment of the present disclosure provides a display device, which includes the display substrate according to any one of the foregoing embodiments. The display device may further include the source driver SDRIVER and the gate driver GDRIVER. The source driver SDRIVER (e.g., the signal output terminals thereof) is coupled to the data signal input terminals INPUT of the multiplexer circuits 5 and supply data signals to the data signal input terminals INPUT, respectively. The gate driver GDRIVER is coupled to the gate lines of the display substrate and supplies a gate scanning driving signal to the gate lines, respectively. For example, the display substrate of the display device shown in FIG. 10 is the display substrate shown in FIG. 1. However, the present disclosure is not limited thereto. Alternatively, the display substrate of the display device shown in FIG. 10 may be the display substrate shown in FIG. 6 or 8.

As described above, in order to realize driving of the display substrate, the display device may further include the source driver SDRIVER and the gate driver GDRIVER. In general, each of the source driver SDRIVER and the gate driver GDRIVER may be in the form of a chip. Alternatively, a gate driving circuit may be formed as the gate driver in the non-display region NA of the display substrate based on a Gate driver On Array (GOA) process. Configuration of the source driver SDRIVER and the gate driver GDRIVER is not limited in an embodiment of the present disclosure. The source driver SDRIVER and the gate driver GDRIVER may be a conventional source driver and a conventional gate driver, respectively.

For example, the display device may be any product or component having a display function, such as electronic paper, an OLED panel, an AMOLED panel, a mobile phone, a tablet computer, a television, a display, a notebook computer, a digital photo frame, a navigator, or the like.

It should be understood that the foregoing embodiments of the present disclosure may be combined with each other in a case of no explicit conflict.

Example embodiments have been disclosed herein, and although specific terms are employed, they are used and should be interpreted in a generic and descriptive sense only but not for purposes of limitation. In the present disclosure, it will be apparent to one of ordinary skill in the art that the features, characteristics and/or elements described in connection with a specific embodiment may be used alone or in combination with the features, characteristics and/or elements described in connection with another embodiment, unless explicitly stated otherwise. Therefore, it will be understood by one of ordinary skill in the art that various changes in form and details may be made therein without departing from the scope of the present disclosure as set forth in the appended claims.

What is claimed is:

1. A display substrate, comprising:

a display region;

a non-display region at a periphery of the display region;

a plurality of pixel units in the display region and arranged in an array;

a plurality of gate lines extending in a row direction of the array; and a plurality of data lines extending in a column direction of the array, wherein each row of pixel units is provided with at least one corresponding gate line, and each gate line is coupled to at least a part of the pixel units in a row corresponding to the gate line;

each column of pixel units is provided with at least two corresponding data lines, and each data line is coupled to a part of the pixel units in a column corresponding to data line; and each of the pixel units is coupled to one of the gate lines and one of the data lines, and two pixel units in a same column and in two adjacent rows are coupled to different data lines, respectively;

the display substrate further comprises a plurality of multiplexer circuit in the non-display region, wherein:

each multiplexer circuit corresponds to at least one column of pixel units; and each multiplexer circuit comprises a data signal input terminal and a plurality of data signal output terminals, the plurality of data signal output terminals are coupled to the data lines provided for the at least one column of pixel units corresponding to the multiplexer circuit, respectively, and the plurality of data signal output terminals are in one-to-one correspondence with the data lines provided for the at least one column of pixel units corresponding to the multiplexer circuit;

wherein each row of pixel units is provided with m corresponding gate lines, and a k-th gate line of the m gate lines is coupled to the pixel units in a $(b\times m+k)$-th column among the pixel units in a corresponding row, where m is a positive integer and $1\leq k\leq m$, b is a non-negative integer and $(b<m+k)\leq M$, and M is a total number of columns of pixel units in the array;

wherein m is 2, and 2 gate lines corresponding to each row of pixel units are a first gate line and a second gate line, respectively; and the first gate line is coupled to the pixel units in odd-numbered columns among the pixel units in the corresponding row, and the second gate line is coupled to the pixel units in even-numbered columns among the pixel units in the corresponding row.

2. The display substrate according to claim 1, wherein each column of pixel units is provided with 2 corresponding data lines, and the 2 data lines are a first data line and a second data line, respectively; and the first data line is coupled to the pixel units in odd-numbered rows among the pixel units in a corresponding column, and the second data line is coupled to the pixel units in even-numbered rows among the pixel units in the corresponding column.

3. The display substrate according to claim 2, wherein every two adjacent columns of pixel units correspond to one multiplexer circuit;

each multiplexer circuit comprises a first switch, a second switch, a third switch, and a fourth switch;

a first terminal of the first switch, a first terminal of the second switch, a first terminal of the third switch, and a first terminal of the fourth switch are all coupled to the data signal input terminal of the multiplexer circuit; and a second terminal of the first switch and a second terminal of the second switch are coupled to 2 first data lines provided for two columns of pixel units corresponding to the multiplexer circuit, respectively, and a second terminal of the third switch and a second terminal of the fourth switch are coupled to 2 second data lines provided for two columns of pixel units corresponding to the multiplexer circuit, respectively.

4. The display substrate according to claim 2, wherein the m gate lines provided for each row of pixel units are on a same side of the row of pixel units.

5. The display substrate according to claim 1, wherein each column of pixel units is provided with n corresponding data lines, where n is an integer and $n\geq 2$;

an i-th data line of the n data lines is coupled to the pixel units in a $(a\times n+i)$-th row among the pixel units in a corresponding column, where i is an integer and $1\leq i\leq n$, a is a non-negative integer and $(a\times n+i)\leq N$, and N is a total number of rows of pixel units in the array.

6. The display substrate according to claim 5, wherein each row of pixel units is provided with 1 corresponding gate line, which is coupled to all of the pixel units in the row.

7. The display substrate according to claim 6, wherein each column of pixel units corresponds to one multiplexer circuit of the plurality of multiplexer circuits, the one multiplexer circuit comprises n switches, wherein first terminals of the n switches are all coupled to the data signal input terminal of the one multiplexer circuit; and a second terminal of a j-th switch of the n switches is coupled to a j-th data line provided for the corresponding column of pixel units, where j is an integer and $1 \leq j \leq n$.

8. The display substrate according to claim 1, wherein the m gate lines provided for each row of pixel units are on a same side of the row of pixel units.

9. A display substrate, comprising:

a display region;

a non-display region at a periphery of the display region;

a plurality of pixel units in the display region and arranged in an array;

a plurality of gate lines extending in a row direction of the array; and a plurality of data lines extending in a column direction of the array, wherein each row of pixel units is provided with at least one corresponding gate line, and each gate line is coupled to at least a part of the pixel units in a row corresponding to the gate line;

each column of pixel units is provided with at least two corresponding data lines, and each data line is coupled to a part of the pixel units in a column corresponding to data line; and each of the pixel units is coupled to one of the gate lines and one of the data lines, and two pixel units in a same column and in two adjacent rows are coupled to different data lines, respectively;

the display substrate further comprises a plurality of multiplexer circuit in the non-display region, wherein:

each multiplexer circuit corresponds to at least one column of pixel units; and each multiplexer circuit comprises a data signal input terminal and a plurality of data signal output terminals, the plurality of data signal output terminals are coupled to the data lines provided for the at least one column of pixel units corresponding to the multiplexer circuit, respectively, and the plurality of data signal output terminals are in one-to-one correspondence with the data lines provided for the at least one column of pixel units corresponding to the multiplexer circuit;

wherein each column of pixel units is provided with n corresponding data lines, where n is an integer and $n \geq 2$;

a i-th data line of the n data lines is coupled to the pixel units in a $(a \times n+i)$-th row among the pixel units in a corresponding column, where i is an integer and $1 \leq j \leq n$, a is a non-negative integer and $(a \times n+i) \leq N$, and N is a total number of rows of pixel units in the array; and wherein n is 4.

10. The display substrate according to claim 9, wherein two of 4 data lines corresponding to a same column of pixel units are on one side of the corresponding column of pixel units, and the remaining two of the 4 data lines corresponding to the column of pixel units are on a side, which is opposite to the one side, of the corresponding column of pixel units.

11. The display substrate according to claim 10, wherein the two data lines on a same side of a same column of pixel units are in different layers, respectively.

12. The display substrate according to claim 11, wherein orthogonal projections of the two data lines, which are in different layers, on a plane where the display substrate is located overlap each other.

13. A display device, comprising the display substrate according to claim 1.

14. A driving method of a display substrate, wherein the display substrate is the display substrate according to claim 1, and the driving method comprises:

writing a gate scanning driving signal to the gate lines sequentially in a predetermined order to drive the pixel units respectively corresponding to the gate lines, and writing a corresponding data signal to the data line coupled to driven pixel units;

wherein a writing time period for writing a data signal to each data line each time is H/c, and an interval between start time points for writing data signals to a same data line twice consecutively is T, where H is a predetermined total time period for completing data writing to all of the pixel units in one row, c is a number of gate lines provided for the one row of pixel units, and $T>H$; and a writing time period for writing a gate scanning driving signal to a same gate line each time is T', where $H<T' \leq T$.

15. The driving method according to claim 14, wherein the writing time period for writing the data signal to each data line each time is H/2;

the interval T between the start time points for writing the data signals to a same data line twice consecutively is 2H; and the writing time period T' for writing the gate scanning driving signal to each gate line each time is 2H.

16. The driving method according to claim 14, wherein each column of pixel units is provided with n corresponding data lines, where n is an integer and $n \geq 2$; an i-th data line of the n data lines is coupled to the pixel units in a $(a \times n+i)$-th row among the pixel units in a corresponding column, where i is an integer and $1 \leq i \leq n$, a is a non-negative integer and $(a \times n+i) \leq N$, and N is a total number of rows of pixel units in the array, and the writing time period for writing the data signal to each data line each time is H;

the interval T between the start time points for writing the data signals to a same data line twice consecutively is $n \times H$; and the writing time period T' for writing the gate scanning driving signal to each gate line each time is $n \times H$.

17. A display device, comprising the display substrate according to claim 9.

18. A driving method of a display substrate, wherein the display substrate is the display substrate according to claim 9, and the driving method comprises:

writing a gate scanning driving signal to the gate lines sequentially in a predetermined order to drive the pixel units respectively corresponding to the gate lines, and writing a corresponding data signal to the data line coupled to driven pixel units;

wherein a writing time period for writing a data signal to each data line each time is H/c, and an interval between start time points for writing data signals to a same data line twice consecutively is T, where H is a predetermined total time period for completing data writing to all of the pixel units in one row, c is a number of gate lines provided for the one row of pixel units, and $T>H$; and a writing time period for writing a gate scanning driving signal to a same gate line each time is T', where $H<T' \leq T$.

* * * * *